United States Patent [19]

Hamm

[11] 4,379,488

[45] Apr. 12, 1983

[54] LATCH FOR WELL TOOL

[75] Inventor: Eddie J. Hamm, Carrollton, Tex.

[73] Assignee: Otis Engineering Corporation, Dallas, Tex.

[21] Appl. No.: 230,879

[22] Filed: Feb. 2, 1981

[51] Int. Cl.[3] ..... E21B 23/02

[52] U.S. Cl. ..... 166/217; 166/216; 166/137; 294/86.18; 285/141

[58] Field of Search ..... 166/217, 215, 216, 137–140; 294/86.18, 86.31, 86.33; 285/141, 142, 143, 319

[56] References Cited

U.S. PATENT DOCUMENTS

| | | | |
|---|---|---|---|
| 3,074,485 | 1/1963 | McGowen | 166/217 |
| 3,250,331 | 5/1966 | Boyle | 166/217 |
| 3,664,689 | 5/1972 | Hanes | 285/141 X |

*Primary Examiner*—Ernest R. Purser
*Assistant Examiner*—Thuy Bui
*Attorney, Agent, or Firm*—Roland O. Cox

[57] ABSTRACT

An improved latch device for releasably locking in a recess in a well flow conductor. The latch is attachable to a well tool which may be positioned and operated to latch and lock in and later be retrieved from the flow conductor using wireline or TFL pumpdown tools and methods. An expandable c-ring is utilized as the latching element for the latch device.

14 Claims, 3 Drawing Figures

LATCH FOR WELL TOOL

BACKGROUND OF THE INVENTION

This invention pertains to equipment used in well flow conductors. More specifically it pertains to a latching device which may be attached to a well tool, installed and locked in a recess in the flow conductor and later unlocked for retrieval from the conductor. The latch device of this invention has the same function as the latch shown in copending United States Application of Harry E. Schwegman for Kickover Tool, Ser. No. 490,557, filed July 24, 1974, now U.S. Pat. No. 4,294,313, herein incorporated by reference. The latch shown in the referenced application is shown in more detail on page 23 of OTIS PUMPDOWN COMPLETION AND SERVICE CATALOG, OEC 5113A.

DESCRIPTION OF THE PRIOR ART

Very frequently it is desirable to install well tools such as flow control devices, gas lift valves and other similar tools, at particular locations in well flow conductors for efficient production or injection flow control and safety purposes. In a liquid well, which no longer contains sufficient reservoir pressure to cause liquid flow to the surface, a gas lift secondary recovery system may be installed to cause liquid flow (production) to the surface. Well gas lift systems require gas lift valves to be installed at particular levels in a well tubing or flow conductor, usually by locating a locking recess in a receptacle or mandrel or in the tubing string and actuating a latching device connected to the valve to latch and lock in the locking recess or grooving in the tubing or mandrel. These latching devices should be of a type which may be unlocked from a mandrel and removed from the tubing for repair or replacement or to repair or replace the valve or flow control connected to the latch.

Many latches of this type have been developed and offer for locking in tubing, landing nipple or side pocket mandrel recesses. Most latches have been developed for attachment to the upper end of flow controls of the type which would be installed in and retrieved from side pocket gas lift mandrels using wireline or pumpdown tools and methods. The top of these latches may be engaged by the appropriate positioning and operating tools to properly position the required well tools in the flow conductor and actuate the latch device to latch and lock in and unlock from the recess. All these devices latch and lock under a part or full circle shoulder above an internal locking recess in the side pocket mandrel. All may be unlocked to remove and retrieve. A number of these latches are shown in U.S. Pat. Nos. 3,074,485 and 3,874,448 to McGowen, Jr., 3,741,601 to Dudley, 3,827,493 to Terral, and 3,863,961 to Dinning.

SUMMARY OF THE INVENTION

The present invention pertains to an improved and simplified latch device which is suitable for use with well tools such as flow control devices or gas lift valves. Unlike prior art latches, the latch device of the present invention uses a c-ring as the latch element, which is expanded to latch and lock and is unlocked and allowed to retract, unlatching the device for retrieval from a well flow conductor. The one piece c-ring latch replaces four latch dogs or lugs of the latch device presently used and eliminates the requirement of cutting four costly square openings in a body to house the latches.

An object of the present invention is to provide an improved latch device consisting of fewer parts, these parts being simplified and less costly to manufacture and more serviceable.

An additional object is to provide a latch device requiring neither welding nor interconnecting threaded parts for permanent assembly.

Another object of this invention is to provide a latch device which when assembled and attached to a well tool is held permanently assembled and operable on attachment to the tool and cannot be disassembled until detached from the tool.

An additional object of this invention is to provide a latch device which utilizes a one-piece expandable c-ring as the latching element.

DESCRIPTION OF THE PREFERRED EMBODIMENT

Figure 1:
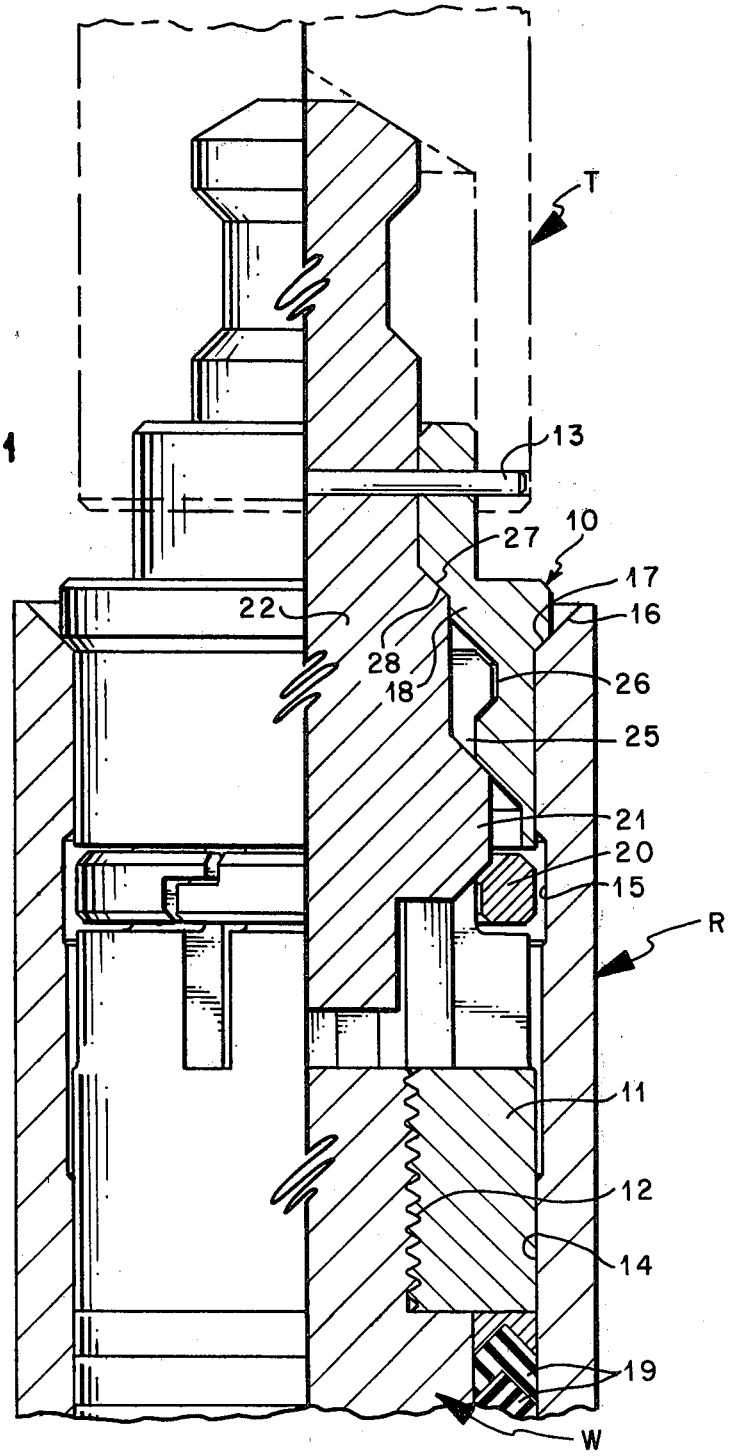
FIG. 1 is a view in elevation and partly in section, showing the preferred embodiment of the latch device of the present invention, attached to a well tool and positioned in a receptacle in a flow conductor, not latched and locked in the receptacle locking recess, and showing upper portions of the receptacle and well tool.

Referring now to drawing FIG. 1, the latching device 10 of this invention in the preferred embodiment comprises a lower body 11 which may be connected to a well tool or flow control W and an upper body 18 with an internal shoulder 28 and an exterior locating flange shoulder 17. Collet fingers 25 on the upper end of the lower body 11 are held engaged in a recess 26 in the upper body by an outside surface (outside diameter from which lugs 21 extend) of expander 22 as the expander is slidably mounted in the upper body 18 and lower body 11 at assembly of the latch device. Attachment of the assembled latch device 10 to a well tool limits down sliding movement of the expander 22 in the assembly which permanently holds all parts in operating position until the latch device is detached from the well tool allowing removal of the expander 22 and complete disassembly of the latch device 10. The upper end of the expander 22, which has an external shoulder 27, may be engaged by a tool T to position and operate the latch device 10 in a well flow conductor. A c-ring latch 20 is retained about the body in a groove formed on engagement of the upper 18 and lower 11 bodies. Camming lugs 21 are provided on expander 22 to expand c-ring latch 20 into latched engagement with recess 15 as expander 22 is forced down inside latch ring 20. The c-ring latch 20 is cut so that its ends overlap even when expanded to latch in recess 15, see FIG. 2, preventing a camming lug 21 from going into the cut and not expanding and centralizing latch ring 20 concentric with the longitudinal axis of the expander 22 and latch device 10. In the preferred embodiment, three expander lugs 21, radially spaced 120° apart, occupy every other slot between the six lower body collet fingers 25 spaced radially at 60°, see FIG. 3. A shear pin 13 through running and operating tool T, upper body 18 and expander 22 positions the expander up in latch ring 20 not expanded position and attaches the latch device 10 to the tool T for positioning and operating in the well flow conductor. The present invention latch device parts are shaped such that they could be readily formed by molding, casting, or machining an appropriate material.

DESCRIPTION OF THE OPERATION OF THE PREFERRED EMBODIMENT

Drawing FIG. 1 depicts the latch device 10 of this invention attached to the upper end of well tool W by engaging threads on the well tool with threads in the latch device lower body 11 at 12. The upper end of latch device 10 has been releasably attached to the lower end of operating tool T (indicated by dash lines) with shear pin 13. Operating tool T carrying latch device 10 and well tool W has been lowered into a well flow conductor having a receptacle R. The receptacle R may be an integral part of a flow conductor, i.e., a landing nipple or a side pocket mandrel. The receptacle R includes a seal bore 14, a locking recess 15 and an internal shoulder 16 at its upper end.

Continued lowering of the operating tool T moves the well tool and latch device into the receptacle until stopped by engagement of flange shoulder 17 on the upper body 18 and receptacle shoulder 16. At this position of the well tool and latch device in the receptacle, the vee seals 19 on well tool W are in sealing engagement in receptacle seal bore 14, and latch ring 20 is opposite locking recess 15.

Figure 2:
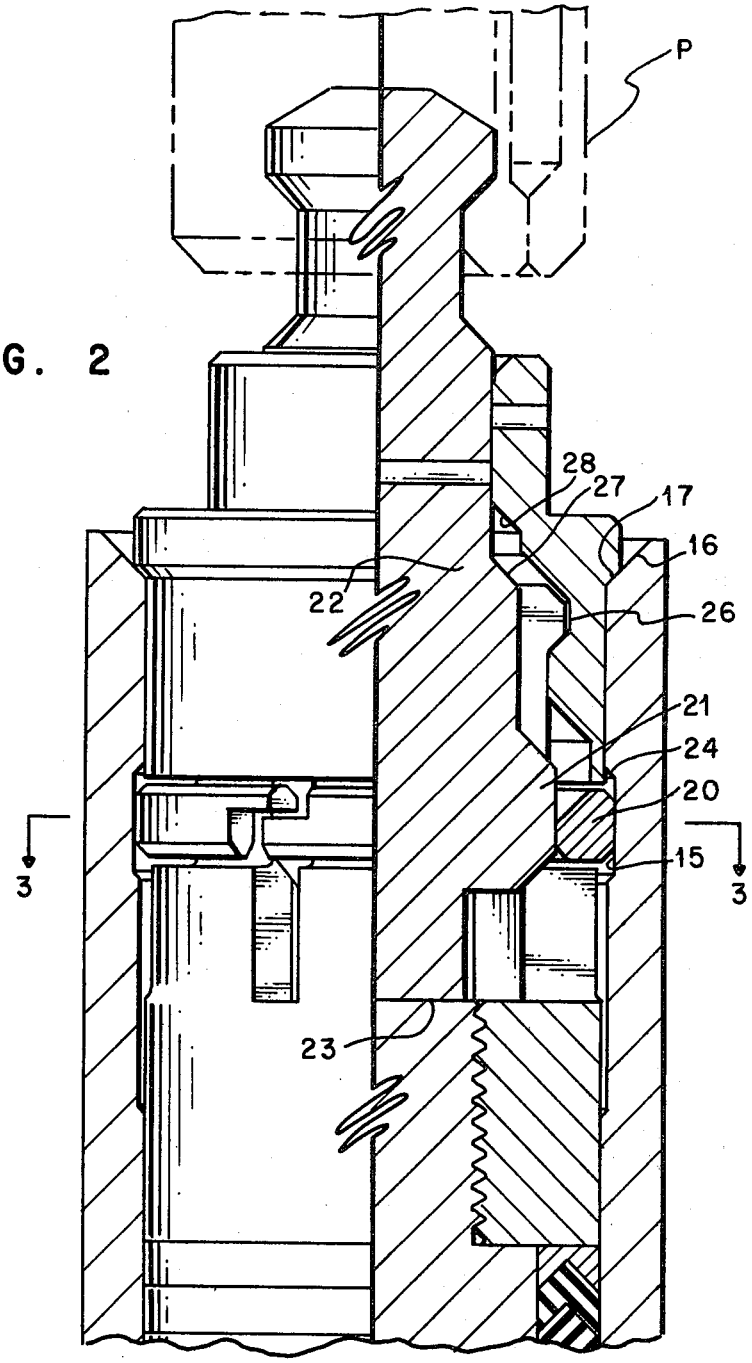
FIG. 2 is another view in elevation, partly in section, showing the preferred embodiment of the latch device latched and locked in a recess in the flow conductor receptacle.
Figure 3:
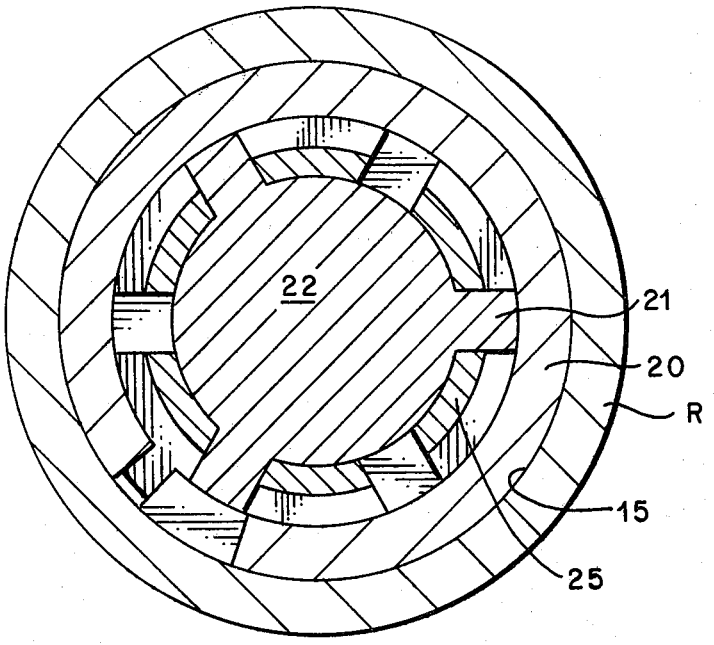
FIG. 3 is a cross section view along section line 3—3 of FIG. 2 showing sections (from outside to in) of the receptacle, latch ring, lower body collet fingers and expander of the present invention.

Further downward movement of operating tool T simultaneously shears pin 13 in four places, see FIG. 2, and forces lugs 21 on expander 22 into latch ring 20, expanding the latch ring to latch in recess 15.

Downward movement of the expander 22 stops on contact of its lower end with the top of well tool T at 23. Latch device 10 is latched in receptacle recess 15, and latch ring 20 now exerts a compressing force on the expander lugs 21. Friction between the contacting surfaces of the latch ring and expander lugs retain the expander in the down position locking the latch device 10 in locking recess 15.

The latch device 10 is now retaining well tool W at the desired position in receptacle R for proper operation of the well. It may be seen in FIG. 2 that any pressure differential thrust up resulting from higher pressure below seals 19 may move latch device 10 up until the latch ring 20 engages the upper internal shoulder 24 of recess 15, stopping up movement. Down movement of the latch device 10 urged by pressure differential thrust from above seals 19 is prevented as flanged shoulder 17 engages (or re-engages) internal receptacle shoulder 16.

As pin 13 was previously sheared, operating tool T may now be lifted and removed from the flow conductor, leaving the latch device 10 and well tool W positioned in the flow conductor for proper operation of the well.

Later the latch device 10 may be unlatched for removal or retrieval from the flow conductor by lowering operating tool P (FIG. 2) to engage the fish neck on the upper end of expander 22. Upward force on operating tool P must exceed locking friction forces between expander lugs 21 and latch ring 20 to lift expander 22 with expander lugs 21 from inside latch ring 20, allowing latch ring 20 to contract and unlatch from recess 15 until expander shoulder 27 contacts internal body shoulder 28. Latch device 10 may be moved freely up from the receptacle and retrieved from the flow conductor.

As shown by the preceding description, this invention is capable of attaining the objects and providing other benefits cited.

The previous description is illustrative of one embodiment of the present invention. Changes and modifications may be made without departing from the scope of the invention as defined by the following claims.

I claim:

1. A device for releasably locking a well tool in a flow conductor which includes a receptacle having a locking recess therein, comprising:

a. body means including:
   (1) an upper body member; and
   (2) a lower body member having means on its lower end for attaching a well tool thereto:

b. means on said upper and lower body members co-engageable for connecting them together preventing substantial longitudinal movement therebetween;

c. holding means mounted in said body means maintaining co-engagement of said co-engagement means;

d. latch means on said body means expandable into engagement with said locking recess; and e. expander means slidably mounted in said body means for expanding said latch means into locking engagement with said locking recess on longitudinal movement of said expander means to a lower position, said expander means being movable to an upper position to allow said latch means to disengage said locking recess, and means on said expander means engageable by an operating tool.

2. The device of claim 1 wherein said co-engageable means comprise a recess in said upper body member and collet fingers on said lower body member, each collet finger having an external boss thereon engageable in said internal recess.

3. The device of claim 1 including means limiting longitudinal movement of the expander means relative to the body means.

4. The device of claim 2 including means engageable with the expander means and the body means for maintaining the expander means in an upper position relative to said body means and releasable to permit said expander means to move downward relative to said body means.

5. The device of claim 4 wherein the means limiting longitudinal movement includes engageable shoulders on said expander means and said body means.

6. The device of claim 5 wherein the releasable engaging means is a shear pin disposed in aligned apertures in the expander means and body means.

7. The device of claim 6 wherein said holding means is a surface on said expander means in position at all times to support said collet fingers against disengagement from said recess of said upper body member.

8. The devices of claims 2, 3, 4, 5, 6, or 7 wherein the latch means is a c-ring and wherein the expander means includes at least one outwardly projecting lug having a camming surface thereon engageable with said c-ring to expand said c-ring into locking engagement with said recess of said receptacle.

9. The device of claim 8 wherein at least one lug on said expander means projects outwardly therefrom between said collet fingers of said lower body.

10. The device of claim 9 in which at least one part thereof is molded of metal.

11. The device of claim 9 including said body means engageable with said receptacle in said flow conductor to limit downward movement of said lock device therein.

12. The device of claim 11 wherein said locating means is an external flange on said body means which on engagement with the flow conductor receptacle positions the latch means for expansion on downward movement of the expander means into latching and locked engagement with said receptacle recess.

13. The device of claim 11 in which at least one part thereof is molded of metal.

14. The devices of claim 12 in which at least one metallic part is formed by casting.

* * * * *